US005456023A

United States Patent [19]

Farnan

[11] Patent Number: 5,456,023

[45] Date of Patent: Oct. 10, 1995

[54] ADVANCE CURE PAINT SPRAY BOOTH

[75] Inventor: Richard S. Farnan, Douglasville, Ga.

[73] Assignee: Ransburg Corporation, Indianapolis, Ind.

[21] Appl. No.: 267,789

[22] Filed: Jun. 28, 1994

[51] Int. Cl.[6] ..... F26B 3/34

[52] U.S. Cl. ..... 34/270; 34/666; 34/88; 454/51; 239/71; 362/96

[58] Field of Search ..... 34/666, 270, 271, 34/272, 233, 225, 88; 15/316.1; 362/96, 110, 111; 454/49–52; 239/71, 73

[56] References Cited

U.S. PATENT DOCUMENTS

| | | | |
|---|---|---|---|
| 3,375,592 | 4/1968 | Heinicke et al. | 34/666 |
| 4,335,526 | 6/1982 | Smith | 34/666 |
| 4,635,381 | 1/1987 | Hubbert | 34/233 |
| 4,761,894 | 8/1988 | Hamasaki et al. | 34/270 |
| 4,771,552 | 9/1988 | Morioka | 34/666 |
| 5,113,600 | 5/1992 | Telchuk | 34/218 |
| 5,144,754 | 9/1992 | Persson | 34/233 |

FOREIGN PATENT DOCUMENTS

| | | | |
|---|---|---|---|
| 3430024 | 2/1986 | Germany | 34/666 |

*Primary Examiner*—Denise L. Gromada
*Attorney, Agent, or Firm*—MacMillan, Sobanski & Todd

[57] ABSTRACT

An advanced cure paint spray booth in which a high volume flow of air is directed over the surfaces of a freshly painted workpiece such as an automobile to accelerate drying. A squirrel cage blower or other high volume blower directs a flow of spray booth air through a plurality of nozzles to flow over the surfaces of the workpiece. The nozzles are individually aimed at surface areas on the workpiece by placing a handle of a directional light source in a nozzle air passage and manipulating the handle to simultaneously direct the light beam and the nozzle at the surface area to be dried. A plurality of nozzles, an air handling manifold and a blower may be formed into a module which is easily retrofitted to existing paint spray booths. When a plurality of modules are mounted in a spray booth, the modules may be independently controlled for increasing air flow only on a a painted area of a workpiece.

9 Claims, 4 Drawing Sheets

ADVANCE CURE PAINT SPRAY BOOTH

TECHNICAL FIELD

The invention relates to paint spray booths and more particularly to an improved quick dry paint spray booth suitable for use with automobiles and other irregular shaped objects.

BACKGROUND ART

In paint shops such as automobile repaint shops, production is limited by the time required for the paint to dry. Spray booths are frequently used both to confine paint overspray and evaporated solvents and to reduce drying time. As used herein, the term "paint spray booth" is intended to cover both spray booths in which workpieces are painted and dried and booths in which a painted workpiece is dried or cured. In the past, paint spray booths often used an array of infrared lamps for applying heat to the painted automobile or other painted workpiece for accelerating drying. The automobile may be heated, for example, to about 130° F. (about 55° C.) during drying. In a downdraft automobile paint spray booth, the automobile is positioned over an open floor grate. Booth air and any entrained paint overspray and solvents are drawn downwardly over and around the vehicle during spraying and drying and exhausted through the floor grate. A vehicle is typically subjected to an air flow on the order of 20 feet per minute (6.1 meters per minute) over horizontal surfaces. In a cross draft booth wherein the air flows in a horizontal direction through the booth, typical surface air flow velocities are about 75 to 100 feet per minute (22.9 to 30.5 meters per minute). When the automobile surfaces are heated to about 130° F. (about 55° C.) at these flow velocities, it may take up to 60 minutes for the entire vehicle to dry sufficiently to permit removal from the spray booth. Until the automobile is dry, it must be kept in the spray booth to prevent damage to the soft paint. It should be appreciated that the total drying time is limited by the slowest drying surface areas which may not be subjected to significant air flow.

In order to increase the number of automobiles that can be painted in a given time, attempts have been made to decrease the drying time that each automobile must spend in the spray booth. Most commonly, infrared heat from permanently installed or portable heat lamps is used. Since the heaters require careful positioning to be effective, permanently installed lamps may not be as effective as portable lamps. Heaters must have electrical interlocks if used inside the booth or they must be rolled out of the booth during spraying to reduce the risk if igniting any flammable solvents. Attempts also have been made to increase the surface air flow over the vehicle. Nozzles have been mounted on rigidly plumbed headers along the booth ceiling. Compressed air is delivered from an external source to the nozzles for increasing the air flow over painted surfaces. However, problems have been encountered with these systems. The fixed nozzles did not offer flexibility with different vehicles. Further, there was an increased risk of contaminating the wet paint with, for example, dust and oil in the compressed air. Typically, the compressed air was obtained from a conventional shop compressor and compressed air distribution systems. However, the air nozzles required a very high air flow rate in order to be effective, thereby increasing the operating costs and consuming compressed air needed for operating spray guns and other shop tools.

DISCLOSURE OF INVENTION

It has been found through comparative tests, that for most paint materials air velocity over the surface being dried has a greater benefit in accelerating drying than does extra heat. This is especially true with the newer waterborne finishes. According to the invention, the sides of a spray booth are fitted with a number of directable high volume air nozzles. The nozzles are individually aimed to provide a desired high air flow rate over the sides and top of the automobile. Further, the nozzles may be aimed specifically at locations which are slow to dry from heat alone. A high volume blower, such as a squirrel cage blower, draws air from near the top of the booth and delivers the air through a manifold to the nozzles. Preferably, a blower and a number of nozzles are formed into a module or air handling device which can be retrofitted into an existing spray booth, as well as be installed in new spray booths. A number of the modules are spaced around the booth for selectively directing air flow at all surface areas of a large workpiece. The high volume air flow through the nozzles significantly accelerates the drying time for a painted automobile or other workpiece. The blowers and the nozzles in the different modules may be independently controlled, allowing the operator to direct air at only an area which was painted for zone drying or to increase the air flow only at areas which dry slower than other areas.

Preferably, each individual nozzle is formed to swivel over a wide directional range, such as at least a 60° global rotation, to facilitate directing the air flow at the surface regions requiring additional drying. It has been found that the nozzles can be accurately aimed by selecting a flashlight or similar directional light source having an external diameter at a handle end which closely engages the internal diameter of the nozzles. Thus, when the handle end of the flashlight is inserted into the nozzle opening, a light beam is directed coaxially in the direction that air is discharged from the nozzle when the flashlight is subsequently removed. The handle end of the flashlight is positioned in a nozzle, the flashlight is turned on and the handle is manipulated to direct the light beam at the automobile surface area where the air flow is to be directed. As the flashlight handle is manipulated the nozzle is rotated and automatically aimed to coincide with the light beam. Consequently, a large number of nozzles may be easily and quickly set for successively drying different automobile models.

Accordingly, it is an object of the invention to provide an improved quick dry paint spray booth.

Other objects and advantages of the invention will become apparent from the following detailed description of the invention and the accompanying drawings.

BEST MODE FOR CARRYING OUT THE INVENTION

Figure 1:
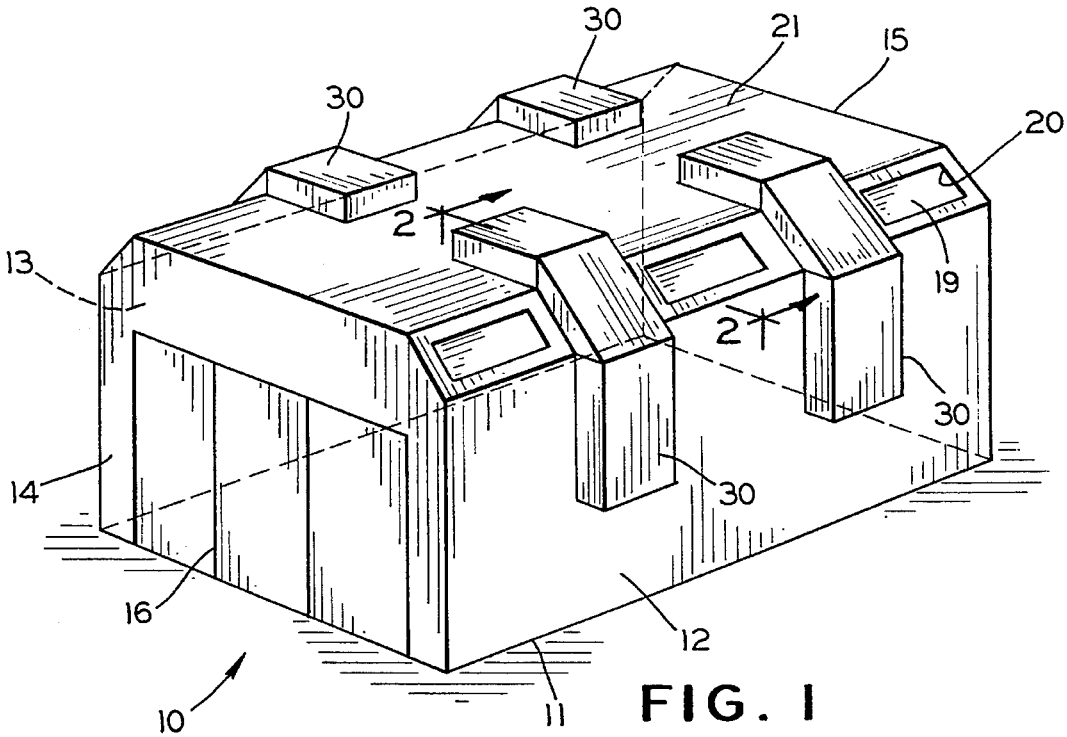
FIG. 1 is a perspective view of an automobile paint spray booth embodying the invention.
Figure 2:
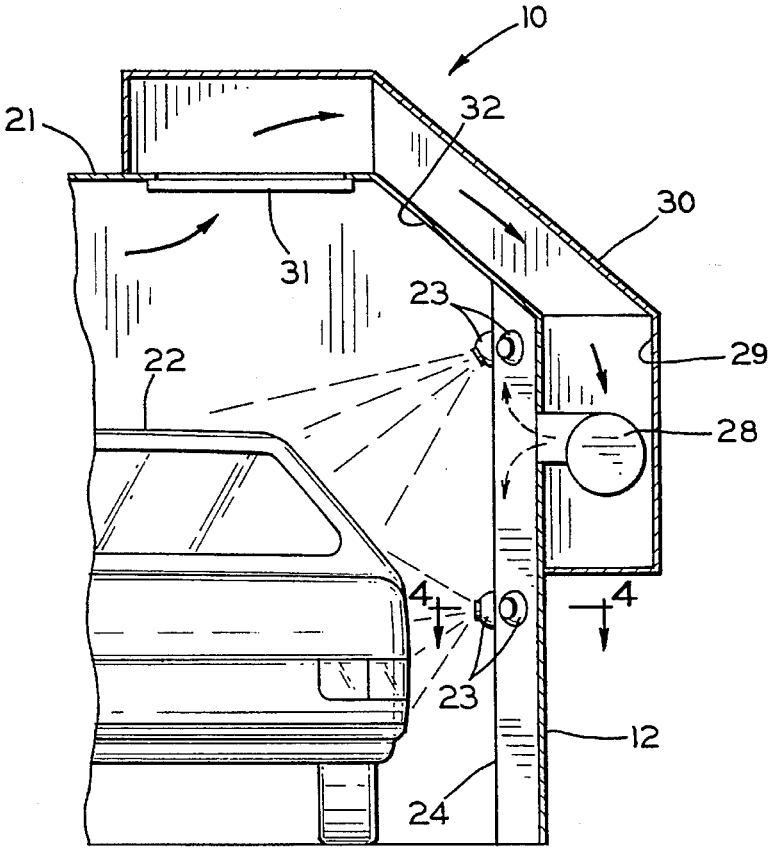
FIG. 2 is an enlarged fragmentary cross sectional view as taken along line 2—2 of FIG. 1.
Figure 3:
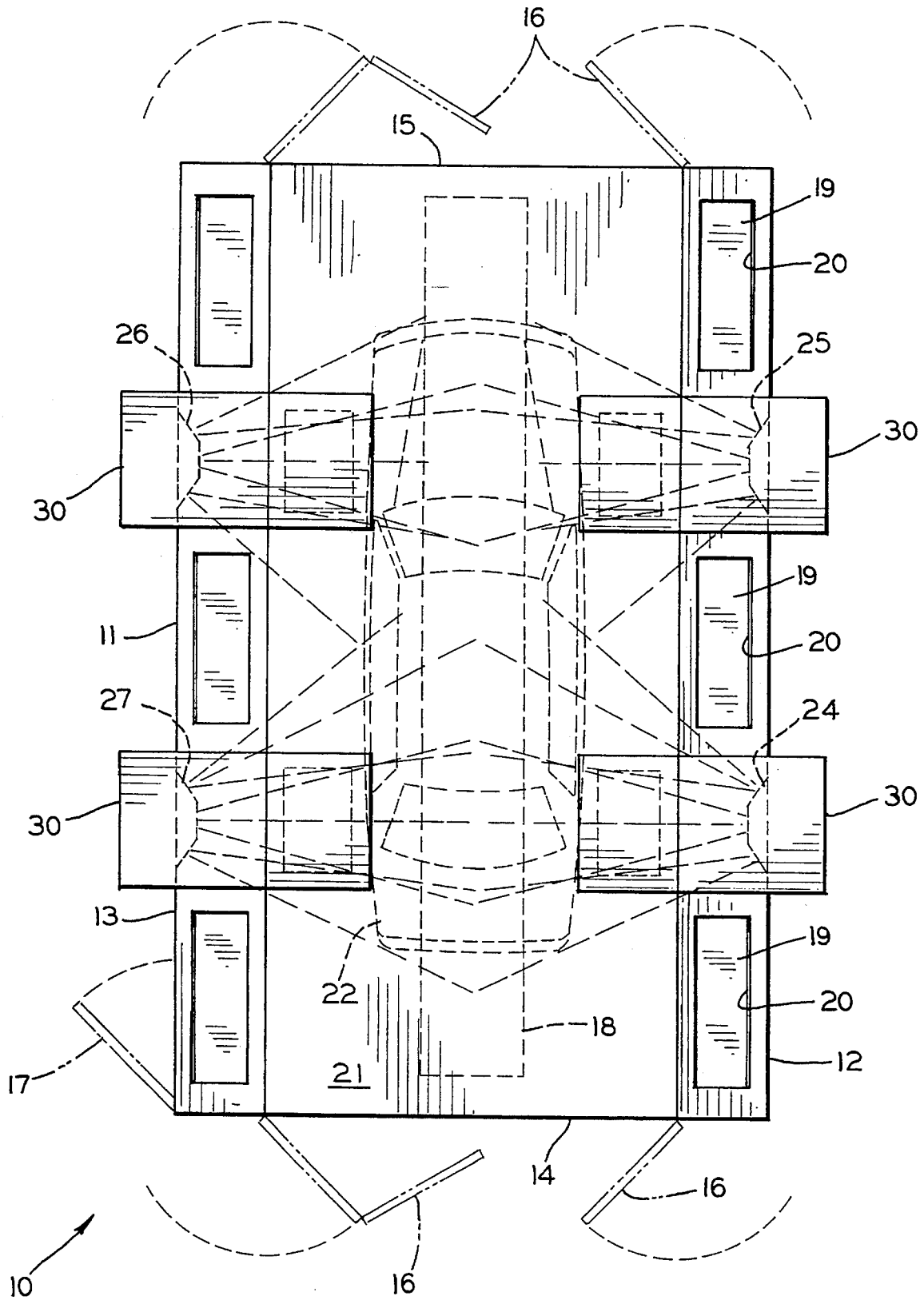
FIG. 3 is a top plan view of the spray booth of FIG. 1.

Referring to FIGS. 1–3 of the drawings, an automobile paint spray booth 10 is shown incorporating one embodiment of the invention. The spray booth 10 generally comprises a closed rectangular housing 11 having opposing sides 12 and 13 and opposite ends 14 and 15. Doors 16 are formed in at least one, and preferably in both, of the ends 14 and 15 to facilitate moving a vehicle into and out of the spray booth 10. An operator door 17 also may be provided on one of the booth sides 12 or 13. The illustrated spray booth 10 is of the downdraft type. Air with any entrained paint overspray and vaporized coating solvents is exhausted from the spray booth 10 through an open floor grate 18. Makeup air is provided by a number of filters 19 in openings 20 in a ceiling 21 of the housing 11. As air is withdrawn through the floor grate 18, outside air is drawn through the filters 19 into the spray booth 10. The filters 19 reduce the risk of damage to a freshly painted vehicle 22 in the spray booth 10 due to dust and other contaminants in the spray booth air.

According to the invention, the drying of the freshly painted vehicle 22 or other workpiece in the spray booth 10 is accelerated by increasing the air flow over the painted surfaces. A number of nozzles 23 (FIG. 2) are located in the spray booth 10 for directing high volume flows of air over predetermined surface areas of the vehicle 22. In the illustrated embodiment, two vertically oriented manifolds 24 and 25 are mounted on the side 12 and two similar manifolds 26 and 27 are mounted on the side 13. As shown in FIG. 2, a blower 28 delivers a pressurized high volume flow of air to the manifold 24. The blower 28 is located within a chamber 29 formed by a housing 30. The chamber 29 communicates through an optional filter 31 with the interior 32 of the spray booth 10. The blower 28 is preferably a squirrel cage blower which provides a high volume flow of low pressure air and may be driven by a relatively low power motor. The motor (not shown) may be located within the squirrel cage or it may be an external motor mounted on the housing 30 exterior to the chamber 29. If flammable coatings are being applied in the spray booth 10, it is preferable to have the motor exterior to the chamber 29 and the spray booth 10 to reduce the risk of igniting vaporized solvents in the spray booth 10. A separate blower 28 and housing 30 is provided for supplying a high volume flow of pressurized air to each of the manifolds 24– 27. Dashed lines in FIG. 3 illustrate typical arrangements for directing air at surface areas of the vehicle 22 to accelerate its drying.

Figure 4:
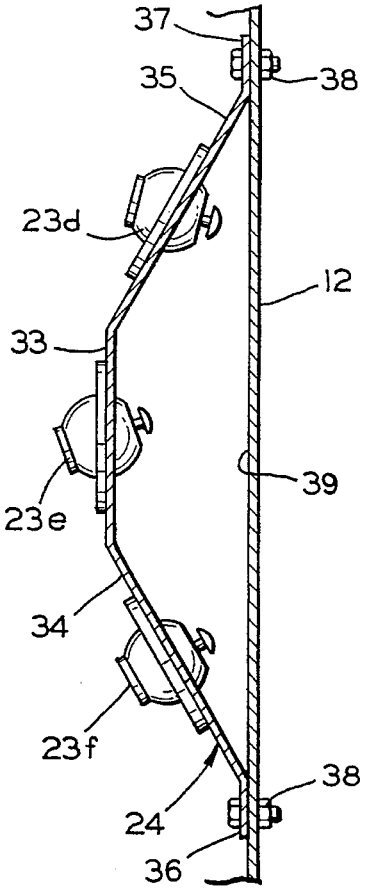
FIG. 4 is an enlarged fragmentary cross sectional view through a manifold as taken along line 4—4 of FIG. 2.
Figure 5:
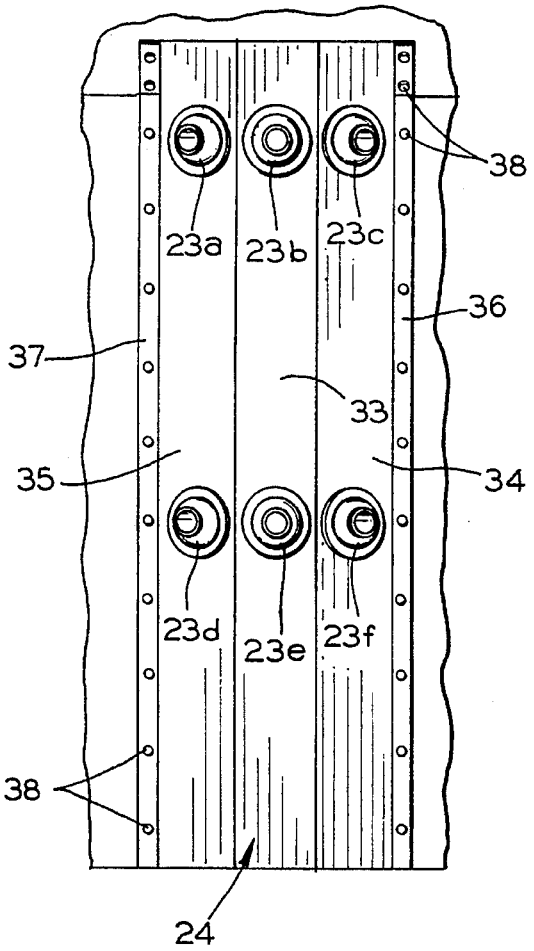
FIG. 5 is a fragmentary side elevational view of the manifold of FIG. 4 showing the mounting arrangement for a plurality of nozzles.
Figure 6:
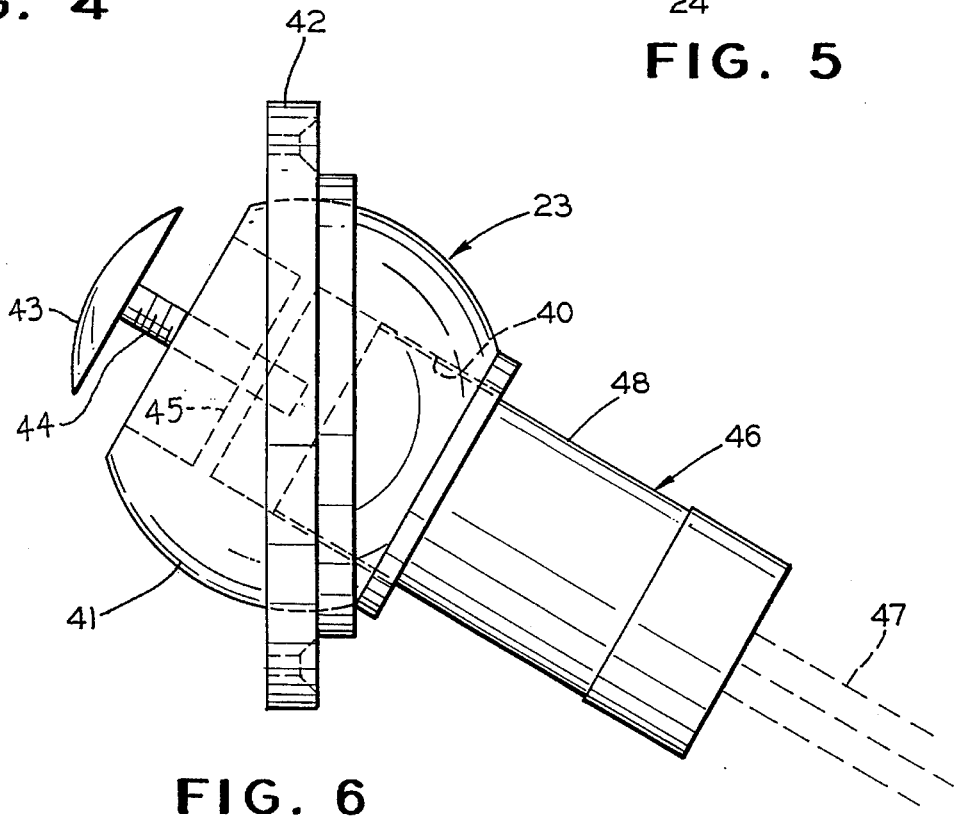
FIG. 6 is an enlarged side elevational view showing details of a nozzle and details of a preferred method for aiming the nozzle.

Turning now to FIGS. 4–6, details are shown for the manifold 24 and the nozzles 23. The manifold 23 is generally formed from a sheet of metal bent to define a vertical flat face 33 which is spaced from and parallel to the spray booth side 12. Two flat vertical faces 34 and 35 angle from the side 33 to the spray booth side 12 and terminate, respectively, at flanges 36 and 37 which abut the spray booth side 12. The flanges 36 and 37 are secured to the spray booth side 12 by any suitable fastening means, such as by bolts 38. The manifold 24 and the spray booth side 12 cooperate to define a closed outlet chamber 39 to which a flow of pressurized air is delivered by the blower 28 (FIG. 2). Three of the nozzles **23*a*, 23*b* and 23*c* are shown mounted in an upper horizontal row and three of the nozzles 23*d*, 23*e* and 23*f* are shown mounted in a lower horizontal row. The nozzles 23*a* and 23*d* are mounted on the side 35, the nozzles 23*b* and 23*e* are mounted on the side 33 and the nozzles 23*c* and 23*f* are mounted on the side 34. The nozzles 23*a*–23*c* are aimed to direct flows of air over the top surfaces of the vehicle 22 and the nozzles 23*d*–23*f* are aimed to direct flows of air over the sides and lower surface areas of the vehicle 22**.

Details of a nozzle 23 are shown in FIG. 6. The nozzle 23 must be capable of being directed or aimed at specific surface areas on the vehicle 22 or other workpiece and must have a sufficiently large diameter interior passage 40 to discharge a high volume low pressure air stream over such surfaces. Preferably, the nozzle 23 includes a ball 41 which is retained to rotate on a mounting plate 42. The passage 40 extends through the ball 41. By rotating the ball 41, the direction of the air flow discharged from the nozzle 23 may be aimed. Optionally, a damper 43 is mounted on a screw 44 which in threaded into a spider 45 in the passage 40. By rotating the screw 44, the damper 43 may be moved closer to or further from the ball 41 for adjusting the air flow through the nozzle 23. An exemplary nozzle 23 of the type described is sold by AirConcepts, Inc. of Tucson, Ariz. The nozzle has a 2.5 inch (6.35 cm) center passage 40 and provides for 60° of global rotation.

When drying automobiles in the spray booth 10, some or all of the nozzles 23 may require aiming for optimum performance each time a different shaped or different size vehicle is to be dried. It has been found that the nozzles may be easily and accurately aimed by using a flashlight 46 or similar light source which directs a light beam 47 axially from a housing or body 48 and has a diameter sized to fit into and closely engage the nozzle passage 40. The nozzle 23 is aimed by inserting the flashlight housing 48 into the nozzle passage 40, turning on the flashlight 46 and manipulating the housing 48 to direct the light beam 47 at the surface area to be dried. As the housing 48 is manipulated, the ball 41 is simultaneously rotated to direct the air discharge passage 40 coaxial with the light beam. Thus, when the flashlight 46 is subsequently removed from the passage 40, air discharged from the passage 40 will flow over the same surface area at which the light beam 47 was directed. A skilled operator will know from experience which surface areas are slowest to dry and can aim the nozzles 23 to accelerate drying of these areas.

Figure 7:
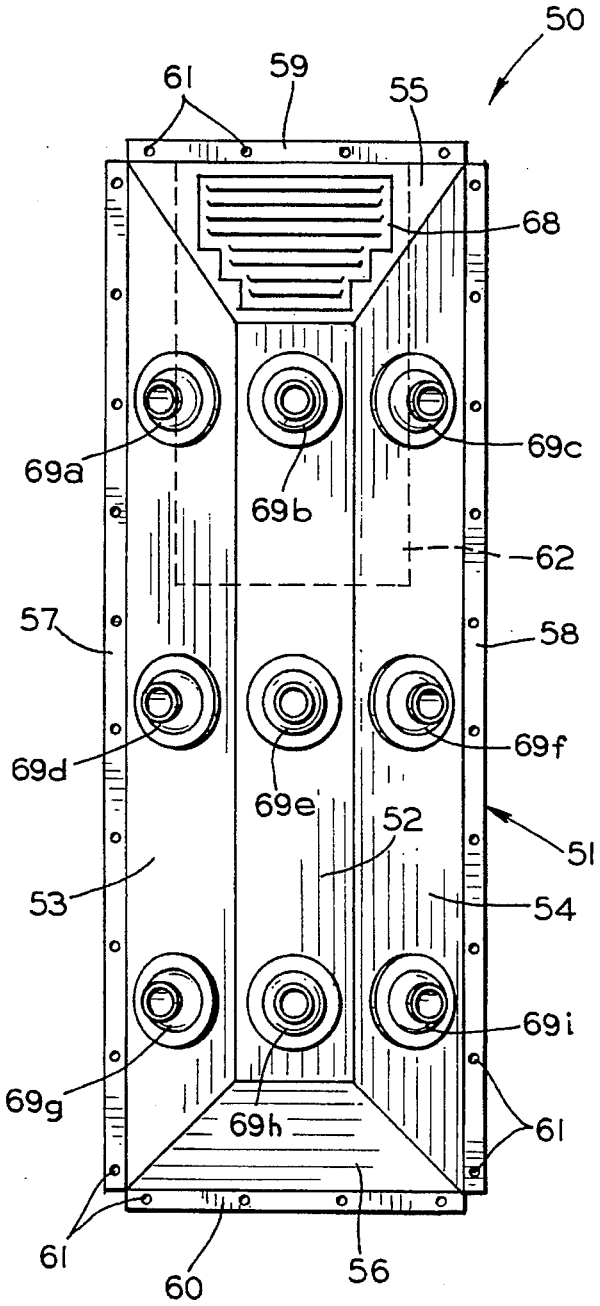
FIG. 7 is a front elevational view of an drying air handling device according to a modified embodiment of the invention.
Figure 8:
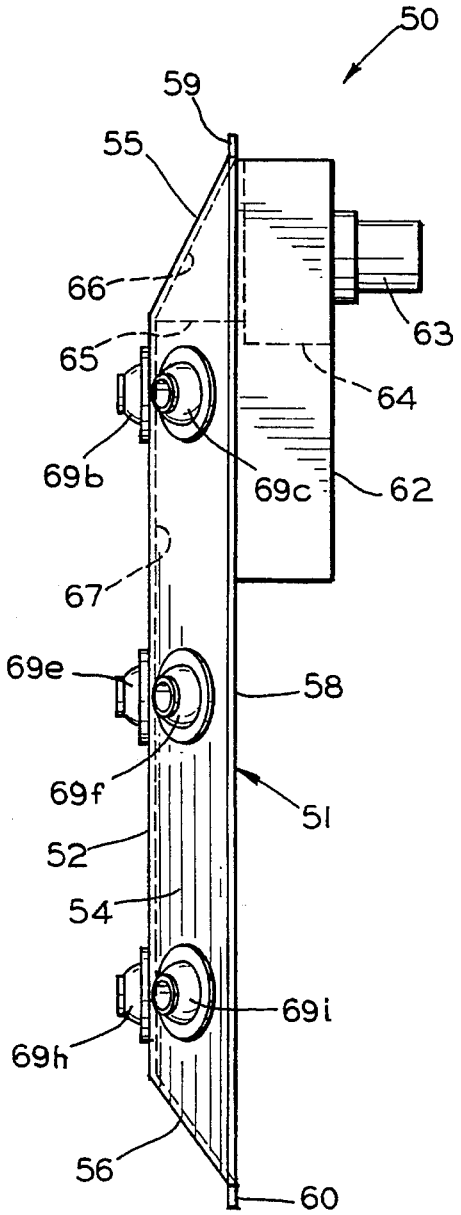
FIG. 8 is a side elevational view of the drying air handling device of FIG. 7.

FIGS. 7 and 8 show an air handling device 50 according to a modified embodiment of the invention which not only may be installed in new paint spray booths, but also is easily retrofitted to existing paint spray booths. The device 50 has a manifold 51 in the shape of a frustum of a right rectangular pyramid. The manifold 51 has an elongated vertical front face 52, two angled elongated side faces 53 and 54, an angled top face 55 and an angled bottom face 56. The faces 53–56 are each connected to a flange 57–60, respectively, which may include spaced openings 61 for securing the device 50 to a spray booth wall (not shown).

A rectangular blower housing 62 extends behind an upper end of the manifold 51. A corresponding opening (not shown) is formed in the spray booth wall to pass the housing 62. A motor 63 is mounted on the exterior of the housing 62 for driving a blower 64 located in the housing. Preferably, the blower is of the squirrel cage type which produces a high volume low pressure air flow. A wall 65 divides the manifold 51 between an upper air inlet chamber 66 and a lower air outlet chamber 67. Louvers 68 are formed in the manifold top face 55 for allowing spray booth air to be drawn into the air inlet chamber 66. The blower 64 draws booth air through the louvers 68 and the inlet chamber 66 and delivers a high volume flow of low pressure air to the air outlet chamber 67. The air delivered to the air outlet chamber 67 is discharged through a plurality of nozzles 69 mounted on the manifold sides 52–54. The nozzles 69 are illustrated as being arranged into an upper row of three nozzles 69*a*–69*c*, a middle row of three nozzles 69*d*–69*f*, and a lower row of three nozzles 69*g*–69*i*.

In an exemplary spray booth, four of the air handling devices 50 were mounted in an arrangement similar to that shown in FIG. 3 for the manifolds 24–27. Each device 50 included a 1/12 hp motor 63 driving a 6.3 inch (16 cm) diameter squirrel cage blower 64 at 1585 rpm. Each blower 64 had an air flow rating of 340 cubic feet per minute (9.6 cubic meters per minute) at 0.1 inch (0.254 cm) static pressure. The four air handling devices 50 were used in addition to heat lamps which heated painted surfaces on a vehicle to about 130° F. (about 55° C.). It was found that the downdraft air flow through the spray booth created a flow rate of about 20 feet per minute (6.1 meters per minute) over horizontal surfaces, while the four air handling devices 50 increased the flow over horizontal surfaces to about 140 feet per minute (42.7 meters per minute). Even greater flow rates occur on the sides of the vehicle. The drying time for sides of one vehicle were reduced from 18 minutes to 8 minutes and the total drying time for vehicle was reduced from about 60 minutes to 8 to 14 minutes. Cross draft booths created a flow of about 75 to 100 feet per minute (22.9 to 30.5 meters per minute) over horizontal surfaces which is an improvement over downdraft booths. The increased flow rate through the use of the air handling devices 50 significantly accelerated the drying time of horizontal surfaces in cross drab booths. Further, vehicles in both cross draft and down draft booths have surface areas which are slow to dry because of low surface air flows. The nozzles 69 are easily aimed to significantly increase the air flow over these surfaces and consequently the air handling devices 50 significantly reduce the total drying time for the vehicle, since the total drying time is limited by the slowest drying surfaces.

The above described exemplary spray booth was provided with four air handling modules or devices 50. It will be appreciated that the actual number of devices 50 used in a spray booth may be varied to meet air flow requirements and based on the size of the spray booth and the workpieces to be dried or cured in the spray booth. Switches for controlling the blowers for the individual air handling devices 50 may be mounted together in a single control panel, allowing the operator to activate one or all of the blowers, depending on the area being dried. The control panel may be at a fixed location on the spray booth or connected to a cable to allow the operator to control the blowers as he/she moves around the spray booth while adjusting the nozzles or painting.

One advantage of the air handling devices 50 is that they only circulate spray booth air over the freshly painted surfaces. Dust and other contaminants are filtered from makeup air as it is brought into the spray booth. Consequently, no separate filters are required and the risk of damaging the painted surfaces before they dry is no greater when the air handling devices 50 are used than when they are not used. This is not true with prior art attempts to increase surface air flow through the use of fixed nozzles operated with compressed air, for example, from shop air lines used to operate other tools. Further, air compressors require significantly greater power to operate than the blowers 64. In order to achieve the same flow rate as that achieved in the above described embodiment using four air handling devices 50, the nozzles must be of the type in which a flow of compressor air induces an increased air flow rate and a compressor flow on the order of 40 to 60 standard cubic feet per minute is required. Thus, an extremely large compressor is required.

In a further modified embodiment of the invention, directional ducts (not shown) may be mounted to extend along the sides and the top of the spray booth. One or more blowers deliver booth air to the ducts which is discharged through elongated slots or nozzles over the workpiece surfaces. Internal vanes in the ducts may be used to direct the discharged air at specific locations on the workpiece.

It will be appreciated that various modifications and changes may be made to the above described preferred embodiment of a quick drying paint spray booth without departing from the spirit and the scope of the following claims. Although the spray booth 10 was described for drying vehicles, it will be appreciated that the invention may be incorporated into spray booths for drying various types of workpieces.

I claim:

1. A method for accelerating drying of a workpiece in a paint spray booth comprising the steps of:

a) aiming a plurality of nozzles at predetermined surface areas on a workpiece in said spray booth;

b) circulating air from said spray booth through a blower; and c) directing flows of said circulated air through said plurality of nozzles to establish a surface flow rates of at least 100 feet per minute over the predetermined workpiece surface areas, and wherein said nozzles are individually aimed at selected ones of said predetermined surface areas by inserting a housing of a directional light source into a selected nozzle, said light source producing a light beam coaxial with the air discharge pattern from such selected nozzle, manipulating said light source housing to direct such light beam at a predetermined surface area while at the same time aiming such selected nozzle at such predetermined surface area, and removing said light source housing from such selected nozzle.

2. A method for aiming a rotatable air nozzle at a predetermined surface area, comprising the steps of inserting a housing of an axially directional light source into said nozzle, said light source producing a light beam coaxial with the air discharge pattern from said nozzle, manipulating said light source housing to direct such light beam at the surface area while at the same time aiming said nozzle at said surface area, and removing said light source housing from said nozzle.

3. An air handling device adapted for mounting on a paint spray booth to accelerate drying of selected surface areas of a painted workpiece in said spray booth, said device comprising a manifold adapted to be mounted on an interior surface of a vertical wall of a paint spray booth, a housing adapted to be located adjacent an outside surface of such spray booth wall and to communicate with said manifold through an opening in such spray booth wall, said manifold defining an air outlet chamber, a plurality of aimable air discharge nozzles mounted on said manifold to receive pressurized air from said air outlet chamber, a blower in said housing adapted to withdraw air from the spray booth and to deliver a pressurized flow of such spray booth air to said outlet chamber, and a motor mounted on said housing to be exterior to the spray booth, separated from the spray booth air and adapted for operating said blower, and wherein said nozzles are adapted to be aimed at selected surface areas of a workpiece located in the spray booth to selectively increase the surface air flow over such areas.

4. An air handling device for mounting on a paint spray booth, as set forth in claim 3, and wherein said manifold has a top area defining an air inlet chamber, a vent means through said manifold for allowing air to flow from the spray booth interior to said inlet chamber, and wherein said blower is adapted to receive air from said inlet chamber and to deliver such received air to said outlet chamber.

5. An air handling device for mounting on a paint spray booth, as set forth in claim 3, and wherein said manifold has first, second and third vertical sides, said first and second sides connected together along vertical edges to extend at an angle, said second and third sides connected together along vertical edges to extend at an angle, and wherein a plurality of said nozzles are mounted on each of said first, second and third sides.

6. An air handling device for mounting on a paint spray booth, as set forth in claim 5, and wherein each of said nozzles includes means for adjusting the air flow through such nozzle.

7. An air handling device for mounting on a paint spray booth, as set forth in claim 5, and wherein each of said nozzles includes a mounting plate secured to one of said sides of said manifold, a ball mounted to rotate in said mounting plate, and an air flow passage extending through said ball.

8. An air handling device for mounting on a paint spray booth, as set forth in claim 5, and wherein said manifold includes a fourth side attached to upper edges of said first, second and third sides, said second and fourth sides connected together along horizontal edges of said second and fourth sides to extend at an angle to each other with said fourth side angled upwardly, and wherein said vent means is formed in said fourth side.

9. A method for painting and drying a workpiece in a paint spray booth comprising the steps of:

a) positioning a workpiece in the paint spray booth;

b) painting at least a portion of the exterior of such workpiece;

c) creating a flow of air through said paint spray booth to accelerate drying of the workpiece, such air flowing over exterior surfaces of the workpiece;

d) directing a plurality of aimable air nozzles at selected exterior surface areas of the workpiece which are slowest to dry due to a low surface air flow; and e) causing sufficient spray booth air to be discharged through said air nozzles to establish surface air flow rates of at least 100 feet per minute over such slowest to dry surface areas.

* * * * *